US005150692A

United States Patent [19]

Trombley et al.

[11] Patent Number: 5,150,692

[45] Date of Patent: Sep. 29, 1992

[54] SYSTEM FOR CONTROLLING AIR SUPPLY PRESSURE IN A PNEUMATIC DIRECT FUEL INJECTED INTERNAL COMBUSTION ENGINE

[75] Inventors: Douglass E. Trombley, Grosse Pointe; Steven D. Stiles, Clarkston; Kenneth J. Buslepp, Shelby Township, Macomb County, all of Mich.; Kenneth J. Buslepp, Shelby Township, Macomb County, both of Mich.

[73] Assignee: General Motors Corporation, Detroit, Mich.

[21] Appl. No.: 807,315

[22] Filed: Dec. 16, 1991

[51] Int. Cl.[5] ..... F02M 23/00

[52] U.S. Cl. ..... 123/533; 123/494

[58] Field of Search ..... 123/533, 494, 435, 179 L, 123/531, 532, 534, 275

[56] References Cited

U.S. PATENT DOCUMENTS

| | | | |
|---|---|---|---|
| 4,756,293 | 7/1988 | Suzuki et al. | 123/533 |
| 4,794,901 | 1/1989 | Hong et al. | 123/533 |
| 4,971,009 | 11/1990 | Washino et al. | 123/494 |
| 5,016,598 | 5/1991 | Kushibe et al. | 123/533 |
| 5,029,569 | 7/1991 | Cullen et al. | 123/494 |
| 5,035,226 | 7/1991 | Nishikawa et al. | 123/494 |
| 5,050,560 | 9/1991 | Plapp | 123/494 |
| 5,080,060 | 1/1992 | Huang et al. | 123/275 |
| 5,085,189 | 2/1992 | Huang et al. | 123/275 |
| 5,086,746 | 2/1992 | Albertson | 123/533 |
| 5,094,217 | 3/1992 | Kaku et al. | 123/533 |
| 5,105,792 | 4/1992 | Ichikawa et al. | 123/533 |

*Primary Examiner*—Raymond A. Nelli

*Attorney, Agent, or Firm*—Jimmy L. Funke

[57] ABSTRACT

A system is disclosed for controlling the pressure in a pressurized air supply for an internal combustion engine having pneumatic direct fuel injection, wherein pressurized air from the supply is utilized to inject fuel held within a fuel injector directly into an engine cylinder, against opposing cylinder compression pressure, while the injector is opened during a cylinder injection period in the engine cycle. The system adjusts the duration of the cylinder fuel injection period in accordance with the sensed pressure in the air supply to maintain the air supply pressure above cylinder compression pressure during the injection period, thereby preventing the backflow of fuel through the cylinder fuel injector into the air supply.

3 Claims, 2 Drawing Sheets

SYSTEM FOR CONTROLLING AIR SUPPLY PRESSURE IN A PNEUMATIC DIRECT FUEL INJECTED INTERNAL COMBUSTION ENGINE

BACKGROUND OF THE INVENTION

This invention relates to a system for controlling the pressure of an air supply for a pneumatic direct fuel injected internal combustion engine, and more particularly, to controlling the air supply pressure for such an engine by adjusting the duration of the fuel injection period in each engine cylinder in accordance with the sensed pressure of the air supply.

Air assisted or pneumatic fuel injection systems are currently being used to inject fuel directly into the cylinders of internal combustion engines. With this type of fuel injection, a metered quantity of fuel is deposited in an injector holding chamber in response to a pulsed fuel signal applied to the injector fuel solenoid. At the appropriate time during the engine cycle, a pulsed air signal is applied to the injector air solenoid to open the injector nozzle and start cylinder fuel injection. During the interval of time that the nozzle is open, commonly referred to as the cylinder injection period, pressurized air supplied to the injector drives the fuel from the fuel chamber and forces it directly into the engine cylinder entrained in the pressurized air. The pressurized air serves to atomize the fuel for clean combustion and enables the fuel to be injected directly into a combustion chamber against opposing cylinder compression pressure.

The pressurized air for the pneumatic fuel injection system is typically provided by an air supply having an engine driven air compressor and an air pressure regulator. For reasons of economy and performance, the output of the engine driven air compressor is generally selected to closely match the requirements of the engine with minimal excess capacity. A pressure regulator is generally used to limit the upper pressure of the air supply in a conventional manner by venting excess air to the engine evaporative canister or intake manifold, when the upper pressure limit is exceeded.

At low speeds and light engine loading, it is known that the timing of injector opening (start of cylinder injection) should be as close to cylinder top dead center (TDC) as possible to limit the dispersion of the injected fuel cloud prior to ignition. This maintains the high degree of charge stratification necessary for stable combustion under these engine operating conditions. However, if the injector remains open past the point where the cylinder compression pressure exceeds the regulated air supply pressure, fuel can backflow through the open injector and into the air supply. This contaminating fuel can damage components of the air supply and can also lead to the loss of fuel vapor to the evaporative canister or intake manifold as the regulator vents excess air in regulating the air supply pressure.

In attempting to prevent the fuel from contaminating the air supply system, the conventional approach has been to select a rotational angle before TDC, where the cylinder compression pressure is not expected to exceed the air supply pressure during engine operation, and then set fuel injection timing to ensure that the end of cylinder injection occurs prior to the selected rotational angle. As discussed previously, it is desirable to time the end of cylinder fuel injection as close as reasonably possible to TDC for a given regulated air supply pressure at low engine speeds and light loading. In doing so, it has been found that fuel contamination of the air supply can still occur in certain circumstances. For example, if a leak develops in the air supply, or the pressure regulator becomes dirty or is improperly set, the air supply pressure can drop below cylinder compression pressure at engine rotational angles prior to the end of fuel injection. It has also been found that fuel contamination of the air supply occurs as the air supply pressure drops due to a reduction in air compressor efficiency when the engine operates at higher altitudes.

SUMMARY OF THE INVENTION

The object of the present invention is to provide a system for controlling the pressure of air in a pressurized air supply for an internal combustion engine having pneumatic direct fuel injection so that the air supply pressure is maintained above cylinder compression pressure during the cylinder fuel injection period, thereby preventing the backflow of fuel into the air supply. This is broadly accomplished by sensing the air supply pressure, and adjusting the duration of the cylinder fuel injection period in accordance with the sensed air supply pressure so that the air supply pressure is maintained above cylinder compression pressure during the injection period.

More specifically, the duration of the injection period is decreased when the sensed pressure of the air supply is below a predetermined pressure setting, and increased when the sensed pressure of the air supply is above the predetermined pressure setting and the injection period is less a determined desired time period.

It has been found that decreasing the duration of the injection period provides an effective technique for maintaining air supply pressure above cylinder compression pressure during the injection period. Since the end of injection is advanced, the magnitude of the opposing cylinder compression pressure is reduced, but more importantly, a smaller volume of pressurized air is expended in injecting the fuel due to the shorter injection period, which effectuates an increase in air supply pressure. Consequently, the present invention provides for the efficient prevention of air supply contamination due to the backflow of fuel through engine fuel injectors, in that the air supply pressure can be maintained above cylinder compression pressure during the injection period, without the use of a larger, higher capacity air compressor.

By providing for the increase and decrease of the duration of the cylinder fuel injection period in accordance with the sensed air supply pressure, the invention is capable of adjusting the air supply pressure to compensate for changes in the efficiency of the air supply compressor, when the engine is operated at different altitudes.

It has also been found that the duration the injection period can be reduced by up to twenty-percent to increase air supply pressure, with no more than a three-percent loss in engine output torque. Further decreases in the duration of the fuel injection period reduce engine output torque more significantly and engine exhaust emissions increase substantially. As a consequence, according to another aspect of the invention, the occurrence of a malfunction is indicated when the duration of the injection period has been reduced by a maximum acceptable amount. This provides a warning of severe leaks or component failure in the air supply, and indicates that further reduction of the injection period will result in degraded engine performance and increased exhaust emissions.

These and other aspects and advantages of the invention may be best understood by reference to the following detailed description of the preferred embodiment, when considered in conjunction with the accompanying drawings.

DESCRIPTION OF THE PREFERRED EMBODIMENT

Figure 1:
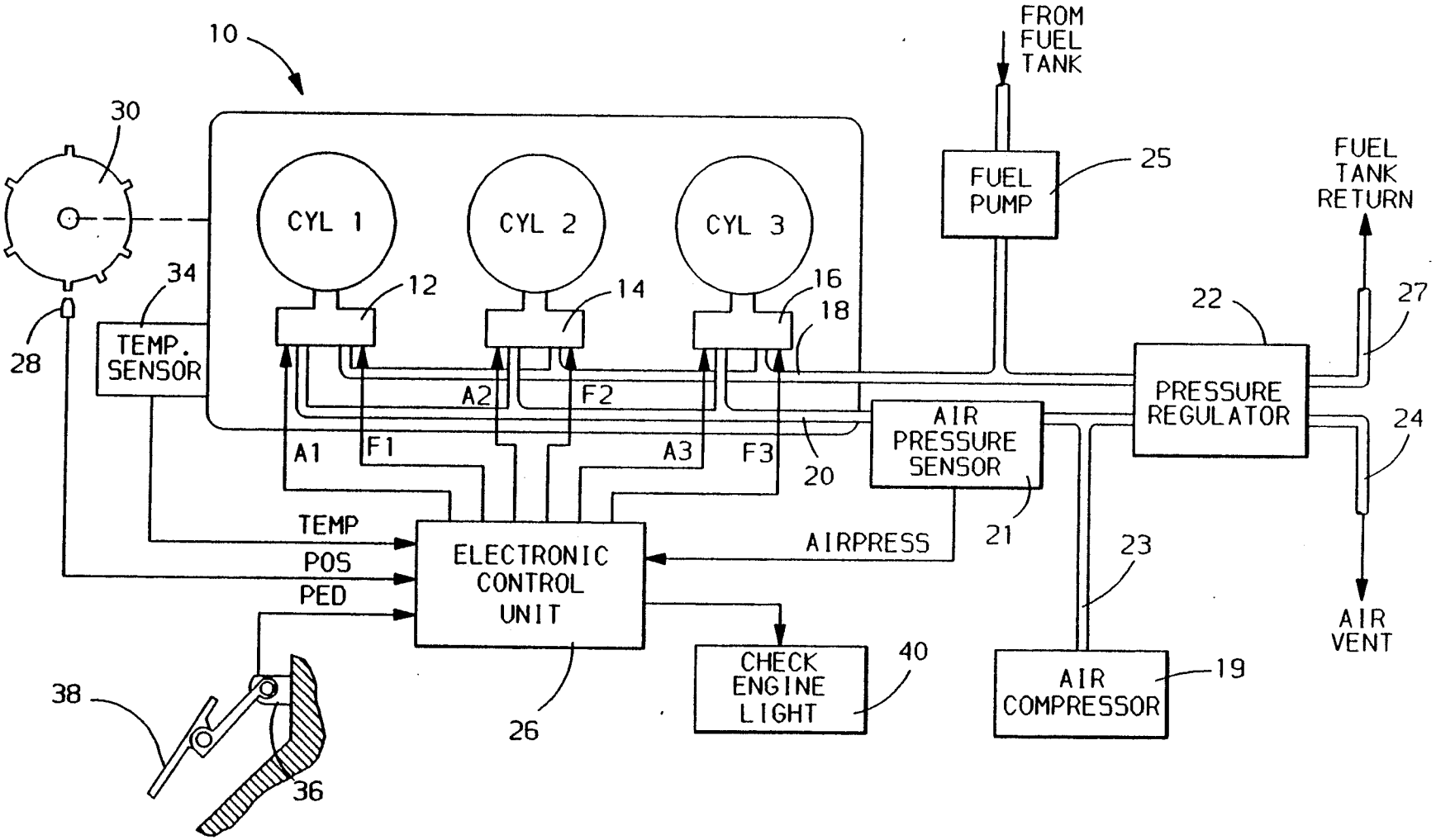
FIG. 1 schematically illustrates a pneumatic direct fuel injected internal combustion engine with a pressurized air supply having its pressure controlled in accordance with the principles of the present invention.

Referring to FIG. 1, there is shown schematically an internal combustion engine, generally designated as 10, having cylinders CYL1, CYL2, and CYL3. Each cylinder is directly fueled with a conventional pneumatic fuel injection system, which includes selectively operable solenoid actuated fuel injectors 12, 14, and 16, with the associated fuel conduit 18 and air conduit 20 for delivering pressurized fuel and air.

An air supply is coupled to conduit 20 for providing a source of pressurized air for the fuel injectors 12, 14, and 16. The air supply includes an air compressor 19, a standard air pressure sensor 21, and a conventional air/fuel pressure regulator 22. The output of air compressor 19 is coupled to pressure sensor 21 and pressure regulator 22 through conduit 23. Pressurized air flows through pressure sensor 21 from conduit 23, and then passes on through conduit 20 to the fuel injectors 12, 14, and 16. Air compressor 19 is typically driven by engine 10, and for reasons of economy and engine performance, the capacity of compressor 19 is generally restricted to closely match the requirements of engine 10, with only minimal excess capacity. Air/fuel pressure regulator 22 restricts the upper air pressure in the air supply to a fixed reference above atmospheric pressure. In a conventional fashion, pressure regulator 22 vents excess air from the air supply through conduit 24 to the engine evaporative canister or intake manifold, when the air pressure in conduit 23 exceeds the reference pressure.

Pressurized fuel is delivered to the injectors 12, 14, and 16 through conduit 18 by the action of fuel pump 25, which draws the fuel from a fuel tank (not shown). The fuel pump output is also coupled to the air/fuel pressure regulator 22 through conduit 18. The pressure regulator 22 is a conventional reference type regulator commonly used in pneumatic fuel injection systems for maintaining a fixed differential pressure between the fuel and air delivered to the injectors 12, 14, and 16. When the pressure of the fuel in conduit 18, exceeds the the reference pressure of the air in conduit 20 by more than a fixed differential pressure, the pressure regulator vents fuel through conduit 27 back to the fuel tank to relieve the excess pressure. A typical fuel/air pressure regulator 22 might, for example, be set to regulate the air in conduit 20 at a pressure of 550 KPa above atmospheric pressure, and maintain the fuel pressure in conduit 18 at 70 KPa above that of the air, or at approximately 620 KPa.

The injection of fuel and operation of engine 10 is controlled by a conventional electronic control unit (ECU) 26, which receives input signals from several standard engine sensors, processes information derived from these input signals in accordance with a stored program, and then generates the appropriate output signals to control various engine actuators.

The ECU 26 includes a central processing unit, random access memory, read only memory, non-volatile memory, analog-to-digital and digital-to-analog converters, input/output circuitry, and clock circuitry, as will be recognized by those skilled in the art of modern computer engine control.

The ECU 26 is supplied with a POS input signal that indicates the rotational position of engine 10. The POS input can be derived from a standard electromagnetic sensor 28, which produces pulses in response to the passage of teeth on wheel 30, as it is rotated by engine 10. As shown, wheel 22 can include a non-symmetrically spaced tooth, to provide a reference pulse for determining the specific rotational position of the engine 10 in its operating cycle. By counting the number of symmetrical pulses in the POS signal that occur in a specified time period, the ECU 26 determines the actual rotational speed (N) of engine 10 in revolutions per minute, and stores the value at a designated location in random access memory.

A standard potentiometer 36 is coupled to an accelerator pedal 38 to provide ECU 26 with a PED input signal. This PED input signal indicates the degree to which the accelerator pedal 38 is depressed in response to operator demand for engine output power. Additionally, a standard coolant temperature sensor 34 is employed to provide ECU 26 with a coolant temperature input signal TEMP, which is indicative of the operating temperature of the engine 10. Note also that air pressure sensor 21 provides ECU 26 with an input signal AIR-PRESS indicating the pressure of air in the air supply.

The engine control system depicted in FIG. 1 shows a conventional check engine light 40, which is customarily included in such systems to provide a warning of malfunctions detected by the ECU 26 during engine operation. When improper engine operation is detected, the ECU 26 provides power to light the check engine light 40, and a fault code corresponding to the detected malfunction is generally stored at a designated nonvolatile memory location. Customarily, ECU 26 provides means for reading out the stored fault code for later diagnostic evaluation of the detected engine malfunction.

During normal engine operation, the ECU 26 looks up a value for the quantity of fuel per cylinder (FPC) to be injected from a table stored in read only memory as a function of the depression of the accelerator pedal 38, as indicated by the PED input signal. The ECU 26 then generates pulse signals F1–F3 and A1–A3 for respectively actuating the fuel and air solenoids (not shown) within fuel injectors 12, 14, and 16, at the appropriate engine rotational angles determined from the POS input signal.

The width of each of the fuel pulses F1–F3 determines the metered quantity of fuel (FPC) that is deposited in a holding chamber within each of the respective fuel injectors 12, 14, and 16. The air pulses A1–A3 are timed by the ECU 18 to open each nozzle (not shown) of the respective fuel injectors 12, 14, and 16, to initiate the start of cylinder fuel injection. The width of each air pulse A1–A3, commonly referred to as the cylinder injection period, determines the length of time that each injector nozzle remains open, and consequently, the timing of the end of cylinder fuel injection. During the cylinder injection period, pressurized air from the air supply enters an injector and drives the metered fuel from its holding chamber, through the open nozzle, and directly into the associated engine cylinder. The pressurized air serves to atomize the fuel for clean combustion and enables the fuel to be injected directly into a combustion chamber against opposing cylinder compression pressure.

Conventionally, the timing of the start of cylinder fuel injection and the duration of the cylinder injection period in the engine cycle are determined from look-up schedules permanently stored in the memory of ECU 26 based upon the current rotational speed of the engine indicated by N; the operating load on the engine indicated by FPC; and the engine operating temperature indicated by TEMP. As will be recognized, the end of cylinder fuel injection timing is established by the start of cylinder fuel injection timing retarded by an amount representing the duration of the fuel injection period.

At low speeds and light engine loading, it is known that the timing of injector opening, or the start of cylinder injection, as defined by the leading edge of each air pulse A1–A3, should be as close to cylinder top dead center (TDC) as possible to limit the dispersion of the injected fuel cloud before ignition. This maintains the high degree of charge stratification necessary for stable combustion under these engine operating conditions. However, if an injector remains open past the point where the compression pressure in its cylinder exceeds the pressure of the air supply, fuel can backflow through the injector and into the air supply. The contaminating fuel damages components in the air supply, and can also lead to the loss of fuel vapor into the engine evaporative canister or intake manifold, when the pressure regulator 22 vents excess air in regulating the air supply pressure.

The conventional approach to preventing such fuel contamination has been to select a rotational angle before TDC, where the cylinder compression pressure is not expected to exceed the air supply pressure during engine operation, and then set the start of fuel injection timing so that the end of injection occurs will occur prior to the selected rotational angle. As stated above, it is desirable to time the end of injection as close as reasonably possible to TDC for a given regulated air supply pressure at low engine speeds and light loading conditions. In doing so, it has been found that fuel contamination of the air supply still occurs under certain circumstances. For example, if a leak develops in the air supply system, or the pressure regulator 22 becomes dirty or improperly set, the air supply pressure can drop below cylinder compression pressure at engine rotational angles prior to the end of cylinder fuel injection. It has also been found that fuel contamination of the air supply occurs when the air supply pressure drops due to a reduction in the efficiency of the air compressor 19, when the engine is operated at higher altitudes.

The present invention provides a system for controlling the pressure of air in a pressurized air supply for a pneumatic fuel injection system so that the air supply pressure is maintained above the compression pressure in each engine cylinder during the cylinder fuel injection period, thereby preventing the backflow of fuel into the air supply. Broadly, this is accomplished by sensing the air supply pressure, and adjusting the duration of the fuel injection period in each engine cylinder in accordance with the sensed air supply pressure.

It has been found that decreasing the duration of the injection period provides an effective technique for maintaining air supply pressure above cylinder compression pressure during the injection period. Since the end of injection is advanced, the magnitude of the opposing cylinder compression pressure is reduced, but more importantly, a smaller volume of pressurized air is expended in injecting fuel due to a shorter cylinder injection period, which effectuates an increase in air supply pressure. It has also been found that the duration the injection period can be reduced by up to twenty-percent for increasing air supply pressure in this fashion, with no more than a three-percent loss in engine output torque. If necessary, the duration of the injection period can be decreased up to fifty-percent and the engine will generally continue to operate, although performance tends to deteriorate and exhaust emissions increase significantly.

Consequently, the present invention provides an economical and effective way to prevent the backflow of fuel through engine fuel injectors into the air supply, without requiring the use of a large capacity air compressor to maintain the air supply pressure when an engine is operated at higher altitudes or the air supply develops moderate leaks. The present invention can be implemented by providing a means for sensing the pressure of the air in the air supply, such as a standard air pressure sensor, and by implementing minor software modifications in the main engine control program.

More specifically, the present invention includes means for sensing the air supply pressure, and means for adjusting the duration of the fuel injection period in each engine cylinder in accordance with the sensed air supply pressure to maintain the air supply pressure above the compression pressure in each cylinder during the cylinder injection period. The duration of the cylinder fuel injection period is decreased when the sensed pressure of the air supply is below a predetermined pressure setting. The duration of the cylinder fuel injection period is increased when the sensed pressure of the air supply is above the predetermined pressure setting and the duration of the injection period is less than a determined desired cylinder injection time period.

Figure 2:
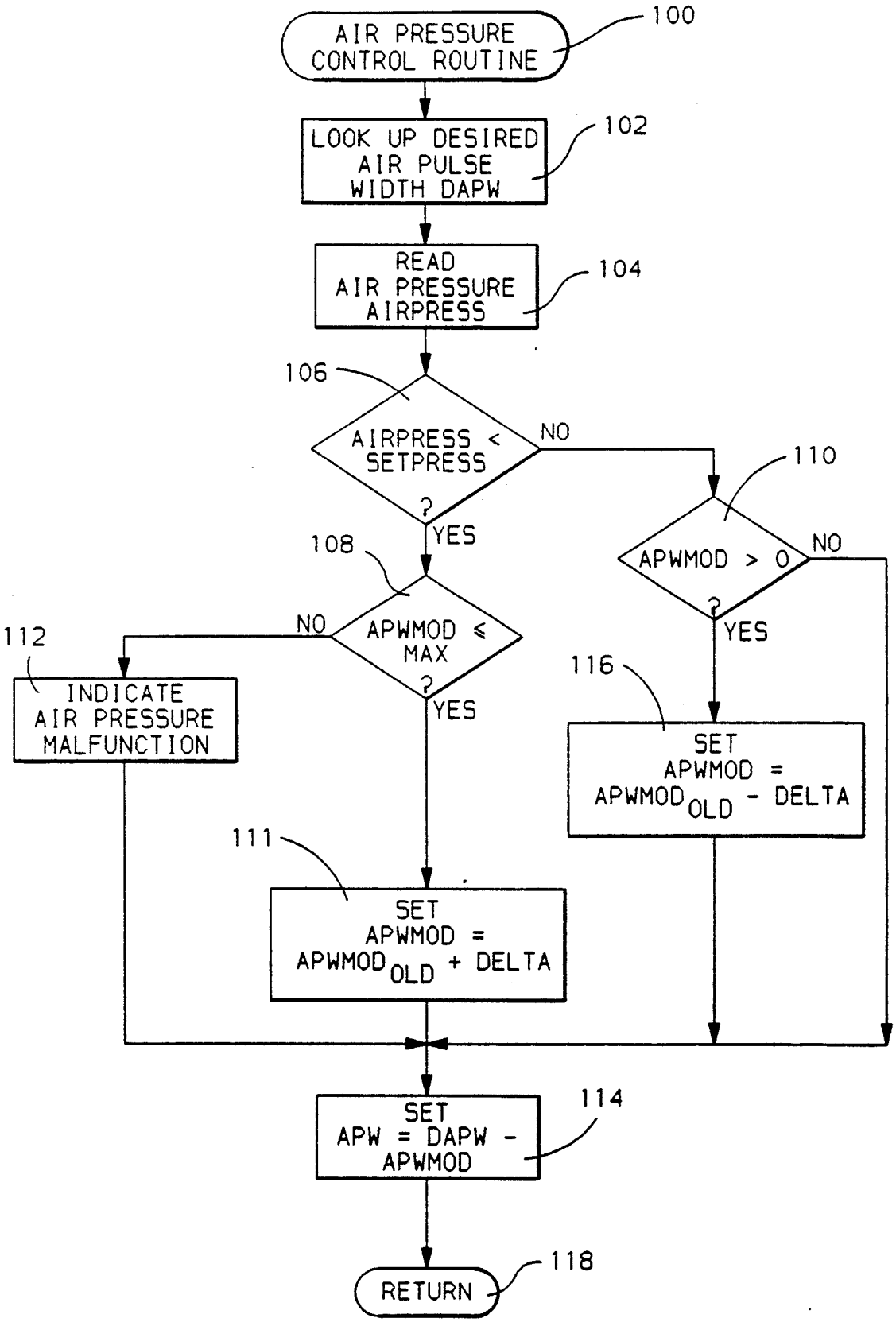
FIG. 2 present a flow diagram representative of the steps executed by the electronic control unit in FIG. 1, when adjusting the duration of the cylinder fuel injection period to control the pressure in the air supply in accordance with the principles of the present invention.

Referring now to FIG. 2, there is illustrated a flow diagram representative of the steps executed by ECU 26 in controlling air supply pressure in accordance with the principles of the present invention. At the time engine 10 is started, all of counters, flags, registers, timers, and the appropriate variables stored in memory locations within the ECU 26 are set to suitable initial values. The AIR PRESSURE CONTROL ROUTINE of FIG. 2 is then executed during every pass through a main looped engine control program permanently stored in ECU 26.

The routine is entered at point 100 and proceeds to step 102, where a value for the desired air pulse width DAPW, which represents the desired duration for the cylinder fuel injection period, is derived from a look-up table stored in the read only memory of ECU 26 as a function of the current engine rotational speed N, the load on the engine indicated by FPC, and the engine operating temperature indicated by TEMP. Look-up table values for DAPW are those found during engine dynamometer calibration to provide the desired fuel economy and exhaust emission levels for the engine (i.e. the conventional values that would normally be used when not practicing the present invention). Typical table values for the desired air pulse width range from 3–6 milliseconds.

Next at step 104, the routine reads the pressure of air in the air supply system, as indicated by the AIRPRESS input signal to the ECU 26 from the air pressure sensor 21.

At step 106, the value for the pressure in the air supply AIRPRESS is compared with SETPRESS, a predetermined pressure setting such as 525 KPa in the present embodiment. If AIRPRESS is less than SETPRESS, the routine proceeds to step 108, otherwise the routine proceeds to step 110.

When the routine proceeds to step 108 from step 106, the current value for an air pulse width modifier APWMOD is compared with a predetermined maximum amount MAX, such as 1.0 milliseconds in the present embodiment. If APWMOD is less than the maximum amount MAX, the routine passes to step 111, otherwise it proceeds to step 112. The variable APWMOD represents the amount by which the desired air pulse width DAPW (found at step 102) will be adjusted at a later point in the routine to increase or decrease the air supply pressure. The value for MAX is generally selected to represent the largest amount by which the desired air pulse width DAPW can be reduced without causing engine 10 to generate an unacceptable level of exhaust emissions.

When APWMOD is greater than the maximum amount MAX, the routine proceeds to step 112, where an air pressure malfunction is indicated. Typically this step includes setting a malfunction flag, which at some point in the main program instructs the ECU 26 to provide power to light the check engine light 40, and then storing a predetermined fault code at a predetermined location in nonvolatile memory to indicate that a malfunction in the air supply system has been detected. From step 112, the routine proceeds to step 114.

When APWMOD is less than or equal to the value MAX at step 108, the routine proceeds to step 111, where a new value for APWMOD is computed by adding a predetermined offset DELTA to the old value of the air pulse width modifier, designated as $APWMOD_{OLD}$, that was computed during the previous pass through the present routine. For the present embodiment, DELTA was selected to be in the order of 0.1 milliseconds. Thereafter, the routine proceeds to step 114.

Returning now to step 106, if the sensed value of the air supply pressure AIRPRESS is not less than the predetermined pressure setting SETPRESS, the routine proceeds to step 110, rather than step 108. At step 110, the value of the air pulse width modifier APWMOD is compared with zero. If APWMOD is greater than zero, indicating that the current air pulse width APW is less than the desired air pulse width DAPW, the routine proceeds to step 116, where a new value for the APWMOD is computed by subtracting the value of DELTA from the old value for the air pulse width modifier, which is again represented by $APWMOD_{OLD}$. Thereafter, the routine proceeds to step 114.

At step 110, if the current value of APWMOD is not greater than zero, indicating that the current air pulse width is equal to the desired air pulse width (i.e. APWMOD=0), the routine then bypasses step 116 and proceeds directly to step 114.

At step 114, a current value for the air pulse width APW is computed by subtracting the current value for the modifier APWMOD from the desired air pulse width DAPW. This value APW then represents the current duration for the cylinder fuel injection period and is stored at a predetermined memory location for later use by the main engine control program when generating the air pulse signals A1–A3 for fuel injectors 12, 14, and 16. After completing step 114, the routine is exited at point 118.

In executing the AIR PRESSURE CONTROL ROUTINE illustrated in FIG. 2, the system provided by the present invention derives a desired time period for the duration of the fuel injection in each cylinder (DAPW) at step 102; senses the pressure of the air (AIRPRESS) at step 104; decreases the duration of the cylinder injection period (APW) when the sensed pressure of the air supply (AIRPRESS) is less than a predetermined pressure setting (SETPRESS) at steps 106, 108, 111, and 114; and increases the duration of the cylinder injection period (APW) when the sensed pressure (AIRPRESS) exceeds the predetermined pressure setting (SETPRESS) and the duration of the injection period is less than the derived desired cylinder injection time period (DAPW) at steps 106, 110, 116, and 114.

In addition, steps 108 and 112 provide for indicating the occurrence of a malfunction in the air supply if the duration of the cylinder injection period (APW) is reduced from the derived desired cylinder injection time period (DAPW) by more than the predetermined maximum amount MAX.

In the above described embodiment of the invention, the timing of the end of cylinder fuel injection is in effect modified by adjusting the duration of the cylinder fuel injection period, while the timing of the start of cylinder fuel injection is not altered from the conventionally determined timing. It will be recognized by those skilled in the art, that the timing of the start of cylinder fuel injection could just as easily be modified when adjusting the duration of the injection period, so that the end of cylinder fuel injection timing would remain as conventionally determined. This could be accomplished at step 114, in the routine of FIG. 2, by including a further computation, where the current value for the air pulse width modifier APWMOD would be added to the conventionally determined value for the start of cylinder fuel injection. Alternatively, only a percentage of APWMOD could be added to the conventional timing for the start of cylinder fuel injection, to vary the occurrence of the modified injection period between the conventional timing values for the start and end of cylinder fuel injection.

The aforementioned description of the preferred embodiment of the invention is for the purpose of illustrating the invention, and is not to be considered as limiting or restricting the invention, since many modifications may be made by the exercise of skill in the art without departing from the scope of the invention.

The embodiments of the invention in which an exclusive property or privilege is claimed are defined as follows:

1. A system for controlling pressure within a pressurized air supply for an engine having pneumatic direct fuel injection, wherein the pressurized air is utilized to inject fuel held within a fuel injector directly into an engine cylinder, against opposing cylinder compression pressure, while the injector is opened during a cylinder injection period in the engine cycle, the system comprising:

means for sensing the air supply pressure; and means for adjusting the duration of the cylinder injection period in accordance with the sensed air supply pressure to maintain the air supply pressure above the compression pressure in each cylinder during the cylinder injection period, thereby preventing the backflow of fuel through the cylinder fuel injector into the air supply system.

2. A system for controlling pressure within a pressurized air supply for an engine having pneumatic direct fuel injection, wherein the pressurized air is utilized to inject fuel held within a fuel injector directly into an engine cylinder, against opposing cylinder compression pressure, while the injector is opened during a cylinder injection period in the engine cycle, the system comprising:

means for adjusting the duration of the cylinder injection period;

mean for deriving a desired time period for the duration of the cylinder injection period;

means for sensing the pressure within the air supply;

means for decreasing the duration of the cylinder injection period when the sensed pressure is less that a predetermined pressure setting; and means for increasing the duration of the cylinder injection period when (A) the sensed pressure exceeds the predetermined pressure setting and (B) the duration of the cylinder injection period is less than the derived desired cylinder injection time period.

3. A system for controlling pressure within a pressurized air supply for an engine having pneumatic direct fuel injection, wherein the pressurized air is utilized to inject fuel held within a fuel injector directly into an engine cylinder, against opposing cylinder compression pressure, while the injector is opened during a cylinder injection period in the engine cycle, the system comprising:

means for adjusting the duration of the cylinder injection period;

mean for deriving a desired time period for the duration of the cylinder injection period;

means for sensing the pressure within the air supply;

means for decreasing the duration of the cylinder injection period when the sensed pressure is less that a predetermined pressure setting; and means for increasing the duration of the cylinder injection period when (A) the sensed pressure exceeds the predetermined pressure setting and (B) the duration of the cylinder injection period is less than the derived desired cylinder injection time period; and means for indicating the occurrence of a malfunction if the duration of the cylinder injection period is reduced from the derived desired cylinder injection time period by more than a predetermined maximum amount.

* * * * *